US005551528A

United States Patent [19]

Vieito

[11] Patent Number: 5,551,528

[45] Date of Patent: Sep. 3, 1996

[54] STEPLADDER WITH LIFTING ASSEMBLY

[76] Inventor: Pedro L. Vieito, 2206 S.W. 60 Ave., Miami, Fla. 33155

[21] Appl. No.: 458,523

[22] Filed: Jun. 2, 1995

[51] Int. Cl.[6] ..... E06C 7/00

[52] U.S. Cl. ..... 182/129; 182/141

[58] Field of Search ..... 182/129, 63, 141

[56] References Cited

U.S. PATENT DOCUMENTS 3,490,558 1/1970 Foley ..... 182/129

*Primary Examiner*—Alvin C. Chin-Shue
*Attorney, Agent, or Firm*—J. Sanchelima

[57] ABSTRACT

A stepladder for positioning equipment and material. The stepladder includes a head step assembly with one or two openings, and a lifting mechanism mounted to the head step assembly. The lifting mechanism removably receives a shaft at one end and the other end passing through one of the openings and removably receiving the equipment and/or material load. The stepladder is mounted over a wheeled platform. The shaft may include a tubular extension and a spring member for dividing the load weight between the stepladder and the shaft, when the latter is in contact with the supporting hole through the pulley housing that removably holds it. An additional shaft can be removably mounted to one of the openings to provide further stability to the structure.

11 Claims, 5 Drawing Sheets

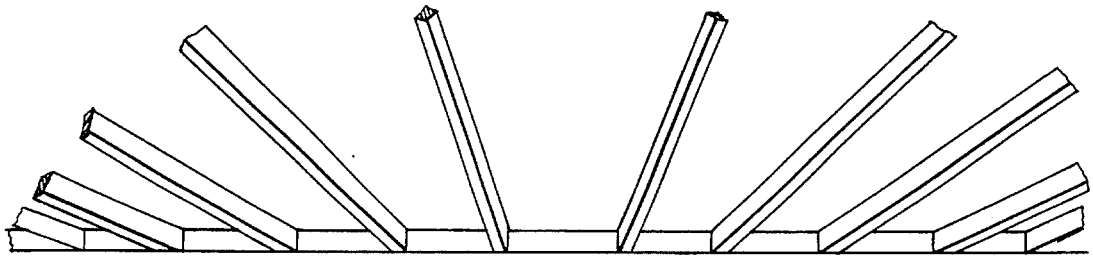
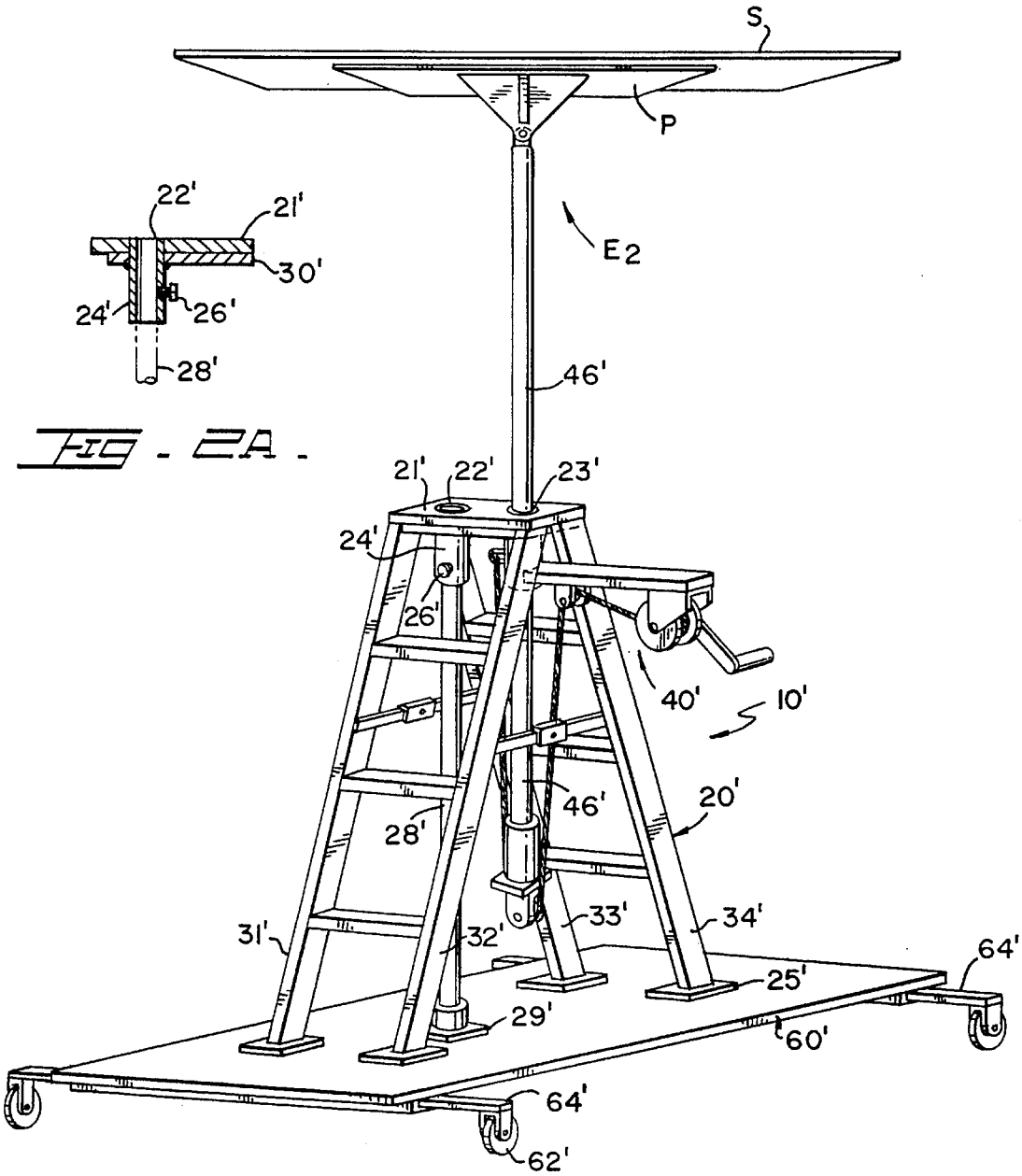
FIG - 2A -
FIG - 2 -

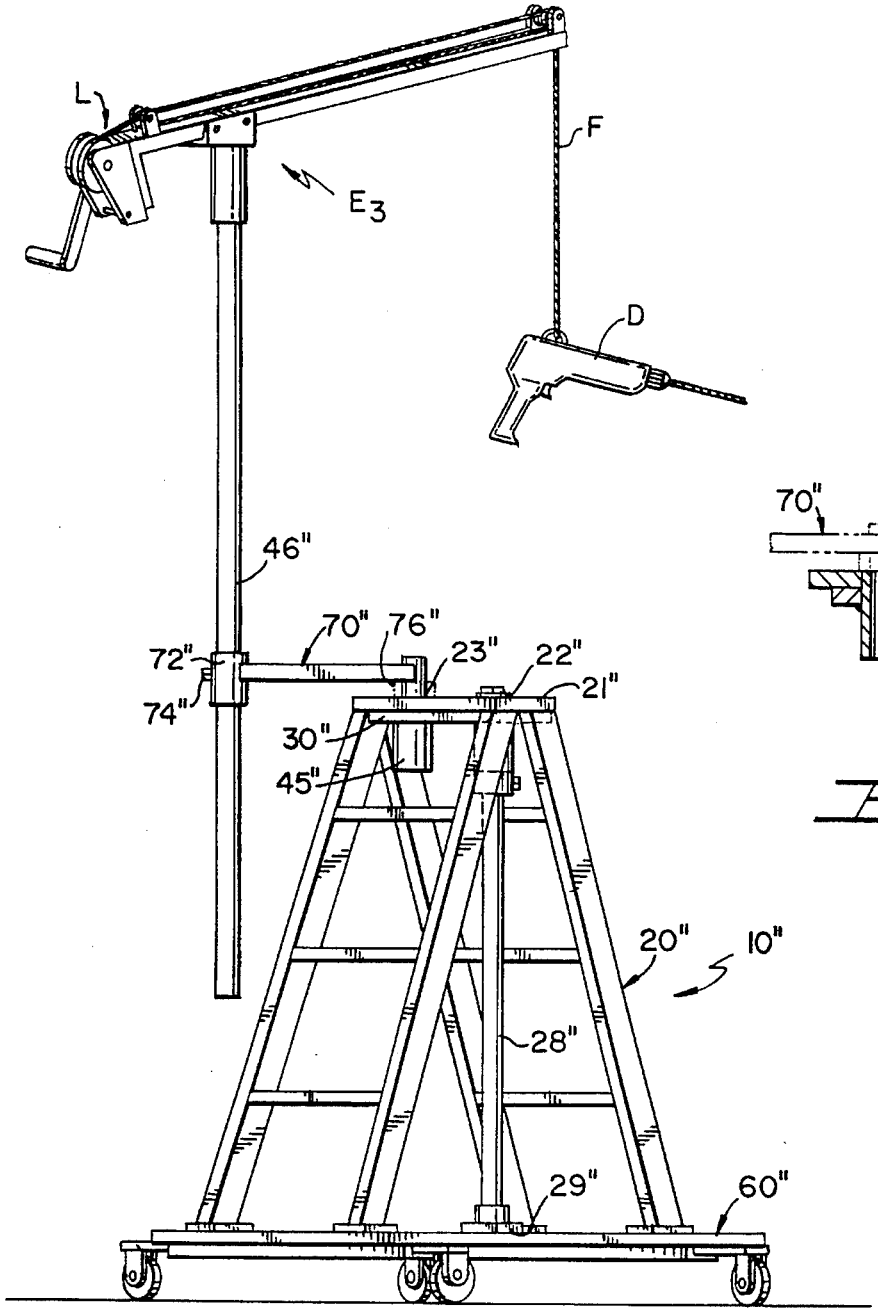
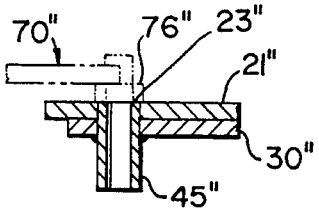
FIG. 3A.
FIG. 3.

STEPLADDER WITH LIFTING ASSEMBLY

BACKGROUND OF THE INVENTION

1. Field of the Invention

The present invention relates to a stepladder, and more particularly, to the type that includes a lifting mechanism for positioning accessory assemblies.

2. Description of the Related Art

Many stepladders have been designed in the past to allow a user to reach areas that he or she could not otherwise have access to. A user typically needs to manipulate heavy loads after climbing the stepladder. However, none of the stepladders known to this date include the novel features of the present invention. This invention discloses a stepladder including a lifting mechanism that permits easily to elevate, lower and manipulate different heavy loads, tools and materials.

III. SUMMARY OF THE INVENTION

It is one of the main objects of the present invention to provide a stepladder with a lifting mechanism that can be used to easily elevate and lower heavy loads, equipment, or material.

It is another object of this invention to provide a stepladder structure and lifting mechanism that can be readily disassembled for easy transportation and storage.

It is still another object of the present invention to provide a stepladder structure with a lifting mechanism that accepts a number of different accessories that are adapted to receive different configurations of equipment, material or things.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 2 shows an isometric view of an alternate of the stepladder mounted on a movable platform P and supporting equipment $E_2$ that supports a sheet of plywood S.

FIG. 2A is partial cross section of the uppermost portion of the stepladder structure showing the guiding tubular member shown in FIG. 2.

FIG. 3 shows an elevational view of the alternate embodiment shown in FIG. 2, but without a lifting mechanism and illustrating another application, in this illustration holding equipment $E_3$.

FIG. 3A is partial cross section of the uppermost portion of the stepladder structure shown in FIG. 2A, showing holding arm assembly passing through.

V. DETAILED DESCRIPTION OF THE PREFERRED EMBODIMENT

Figure 1:
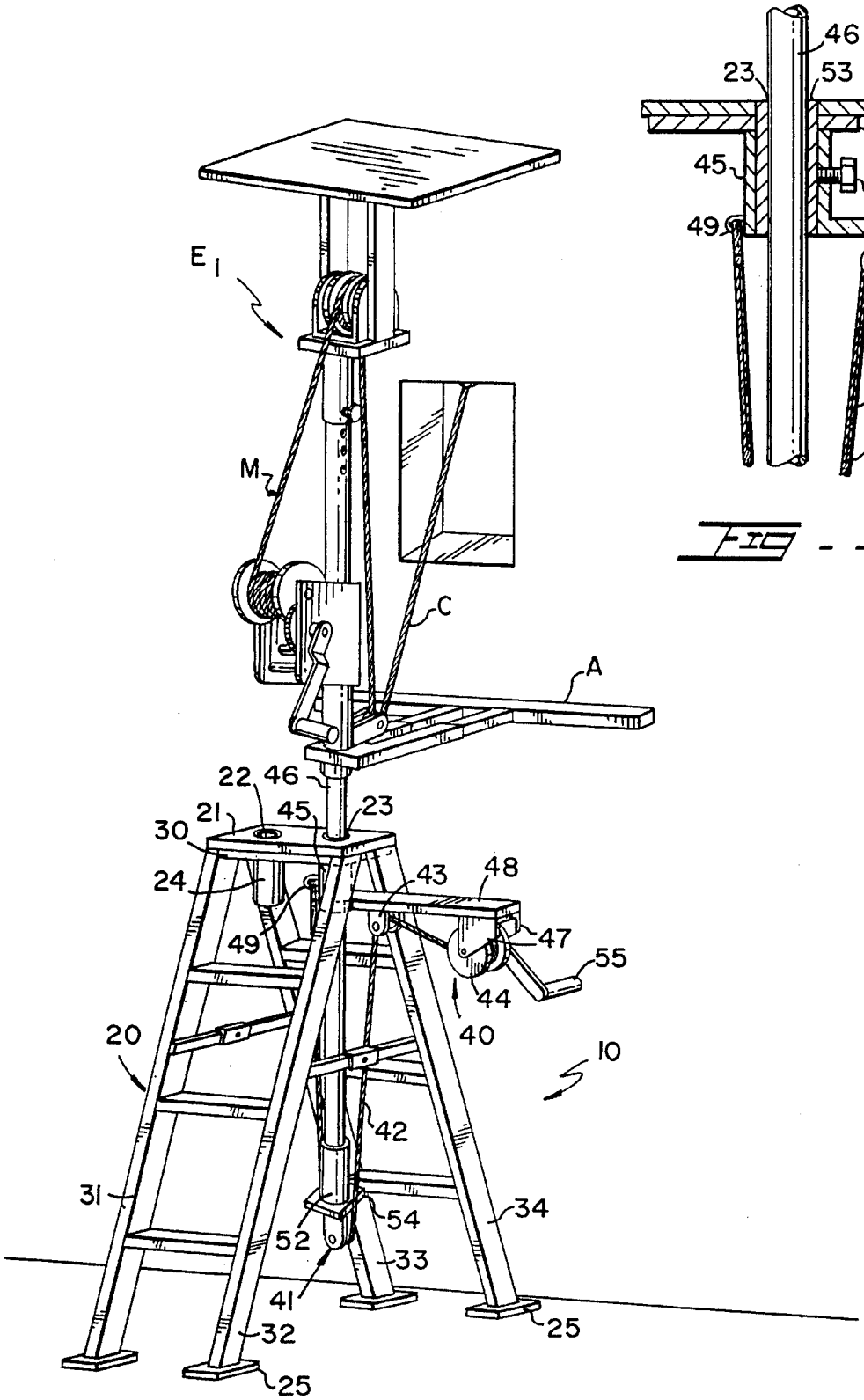
FIG. 1 represents an isometric view of the preferred embodiment of the present invention, wherein a stepladder includes a lifting mechanism that includes a shaft to which equipment $E_1$ has been removably mounted.

Referring now to the drawings, where the present invention is generally referred to with numeral 10 in FIG. 1, it can be observed that it basically includes stepladder structure 20 with lifting mechanism 40 for raising and lowering equipment, tools and supplies.

Figure 1A:
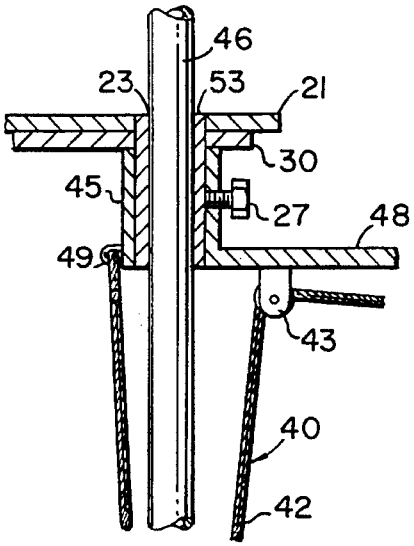
FIG. 1A represents a partial cross-section of the portion of the lifting mechanism shown in FIG. 1, mounted to the uppermost portion of the stepladder.

Stepladder structure 20 has lifting mechanism 40 removably mounted to reinforcement plate 30 which in turn is rigidly mounted to the underside of head step 21, as best seen in FIGS. 1 and 1A. Stepladder structure 20 includes legs 31; 32; 33 and 34 that are pivotally mounted to the underside of head step 21 and rest on the floor through shoe members 25. Head step 21, in the preferred embodiment, includes two openings, 22 and 23. Guiding tubular member 24 is mounted (welded) to the inner wall of opening 22 of head step 21. Similarly, guiding tubular member 53 is also mounted to the inner wall of opening 23.

As shown in FIG. 1, equipment $E_1$ is supported by shaft 46 which in turn is held by lifting mechanism 40. Shaft 46 is, at its lowermost end, removably received by tubular receiving member 52 of lifting mechanism 40. Shaft 46, in the preferred embodiment, passes through guiding tubular member 53 mounted to opening 23 of head step 21. Tubular member 45 of lifting mechanism 40 is removably mounted to guiding tubular member 53 by set screw 27. Cable 42 is trained over pulley assembly 41 to cooperative lift and lower tubular receiving member 52. Pulley assembly 41 is rigidly mounted to the underside of plate 54. The underside of plate 54 is mounted to tubular receiving member 52, in the preferred embodiment. Cable 42 is tied, at one end, to loop member 49 that is rigidly mounted to tubular member 45 in the preferred embodiment. Cable 42 also passes through pulley assembly 43, and is collected by spool 44. Pulley assembly 43 is rigidly mounted to the underside of arm member 48 and the latter is rigidly mounted to tubular member 45. Spool 44 is rotatably mounted to bracket 47 which in turn is rigidly mounted to the underside of arm member 48. When a user desires to lift equipment $E_1$ up, he or she actuates crank 55 mounted to spool 44. Equipment $E_1$ is an equipment used for pulling electrical cables through electrical pipes. Equipment $E_1$ is removably mounted to shaft 46 which basically comprises pulling cable C, pulling mechanism M and supporting arm assembly A that rests against a wall to provide a supporting point for equipment $E_1$.

In FIG. 2, alternate embodiment 10' is illustrated. Head step 21' has openings 22' and 23', which are similar to openings 22 and 23 in the preferred embodiment. Stepladder structure 20' includes supporting shaft 28' mounted, at its uppermost end, within guiding tubular member 24' and secured by set screw 26'. Guiding tubular member 24' is welded to the underside of reinforcement plate 30' and consequently rigidly mounted to head step 21', as best seen in FIG. 2A. Tubular member 24' and opening 22' are coaxially disposed. Shaft 28', at its lowermost end, is removably mounted to shoe 29' which in turn rests on movable platform 60' in the alternate embodiment. Movable platform 60' includes four wheels 62' which extend outwardly and retract by telescopic arms 64' mounted to the underside of platform 60'. Telescopic arms 64' are designed to bring more stability to stepladder structure 20' which in turn is supporting equipment $E_2$ and a user moving thereon. Lifting mechanism 40' lifts and lowers equipment $E_2$ with shaft 46' passing through opening 23'. Equipment $E_2$ basically comprises platform P supporting a sheetrock or sheet of plywood S. Shoe members 25' and 29' are designed to distribute the weight transmitted through legs 31'; 32'; 33' and 34' of stepladder structure 20'.

As shown in FIGS. 2; 3 and 5, structures 20'; 20" and 20"" are mounted on movable platforms 60'; 60" and 60"", respectively. This permits the ready transportation of structures 20'; 20" and 20"" to where it is needed.

In FIG. 3 alternate embodiment 10" is shown. Stepladder structure 20" has openings 22" and 23" located in head step 21" and reinforcement plate 30". Supporting shaft 28" is mounted to the underside of head step 21" and, at its lowermost end, rests on shoe 29" which in turn rests on platform 60". Opening 23", in this alternate embodiment, receives holding arm assembly 70" mounted within tubular member 45" and the latter is welded, in this embodiment to the underside of reinforcement plate 30". Spacer 76" raises arm assembly 70" to clear head step 21" thereby permitting to former to rotate freely, as best seen in FIG. 3A. Arm assembly 70", in this alternate embodiment, includes tubular member 72" mounted at its distal end. Set screw 74" secures shaft 46" in place. Shaft 46" cooperatively extends upwardly parallel to stepladder 20" so that equipment $E_3$ is not in a user's way when he or she steps on stepladder 20". Equipment $E_3$ basically comprises lifting mechanism L with elastic cable M that holds driller D in this application.

Figures 4, 4A, 4B:
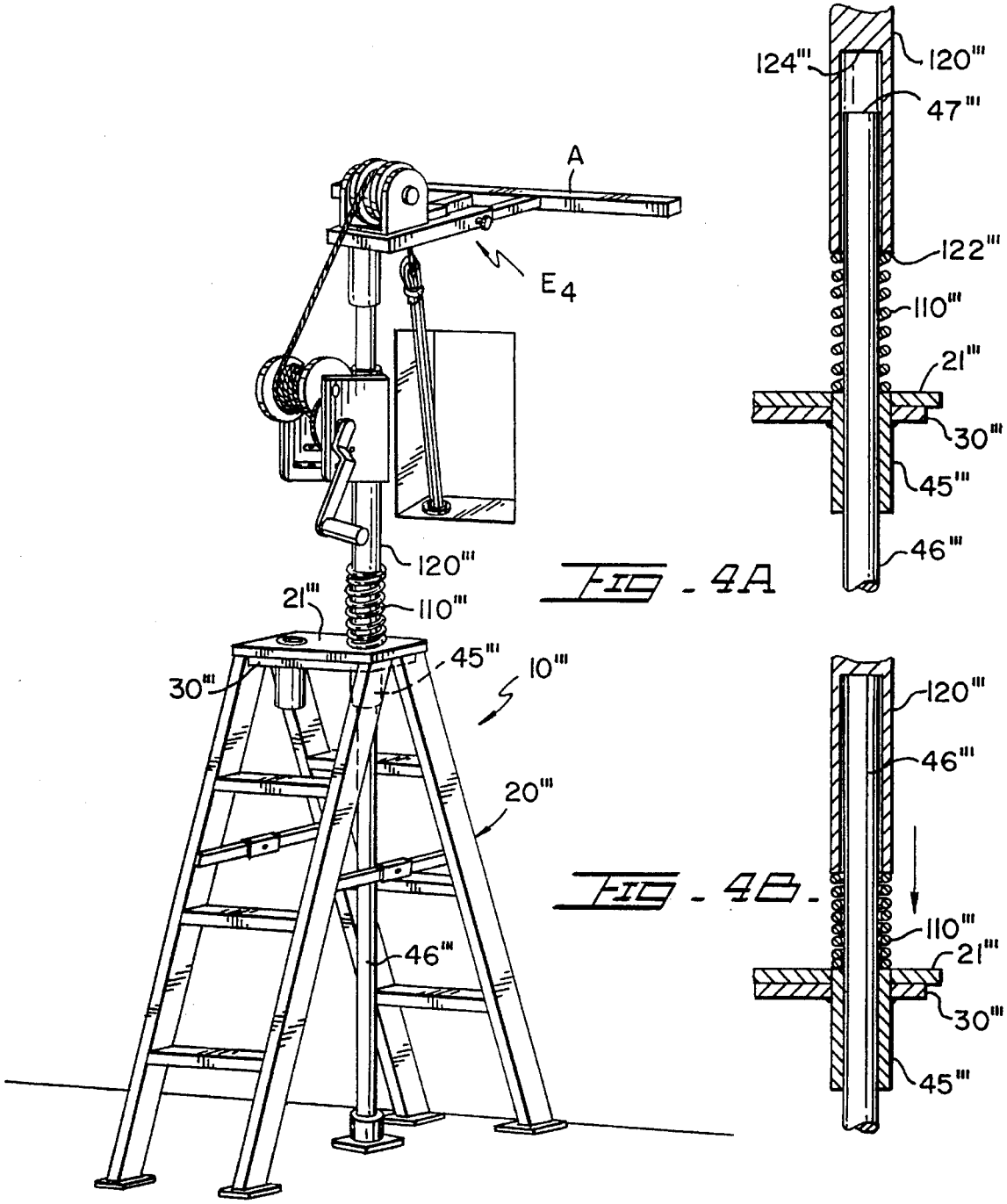
FIG. 4 illustrates an isometric view of another application of the present invention and showing a spring mounted on the head step to divide the weight applied by equipment $E_4$, so that a predetermined weight force is applied to the stepladder and the rest can be directed to the supporting ground.
FIG. 4A is a partial cross section of the uppermost portion of the stepladder structure showing the spring in distended state.
FIG. 4B is a partial cross section of the embodiment shown in FIG. 4A and showing the spring in contracted state.

In FIG. 4 alternate embodiment 10'" is shown. Stepladder structure 20'" serves as supporting base for equipment $E_4$ which is similar to equipment $E_1$. However, equipment $E_4$ differs because supporting arm assembly A is mounted to the uppermost portion of equipment $E_4$ and an electric cable is pulled out and up. The alternate embodiment 10'" includes spring 110'" removably coaxially housing a portion of supporting shaft 46'". One end of spring 110'" rests on guiding tubular member 45'". The other end comes in contact with the lower edge 122'" of tube 120'". As it can be seen in FIGS. 4A and 4B, spring 110'" is compressed when the weight of equipment $E_4$ is transmitted through tube 120'". Depending on the characteristics of spring 110'", a predetermined portion of the weight is transmitted through spring 110'" to step ladder assembly 20'". Up to a predetermined portion of the weight is transmitted to guiding tubular member 45'" which is rigidly mounted to plate 30'" and head step 21'". If the weight of equipment $E_4$ exceeds that predetermined portion of its weight, the excess of the weight force is transmitted through stopping surface 124'" to upper end 47'" which in turn transmits this excess weight force down through shaft 46'" to the supporting surface or ground. Spring 110'" is designed to partially absorb the weight force applied to stepladder structure 20'" to enhance the stepladder's stability without constituting an excessive force thereon.

Figure 5A:
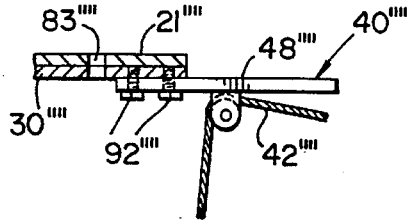
FIG. 5A is a partial cross section of the uppermost portion of stepladder structure and an elevational view of the portion of the lifting mechanism that is mounted to the underside of the uppermost portion of stepladder structure, taken along line 5A.
Figure 5:
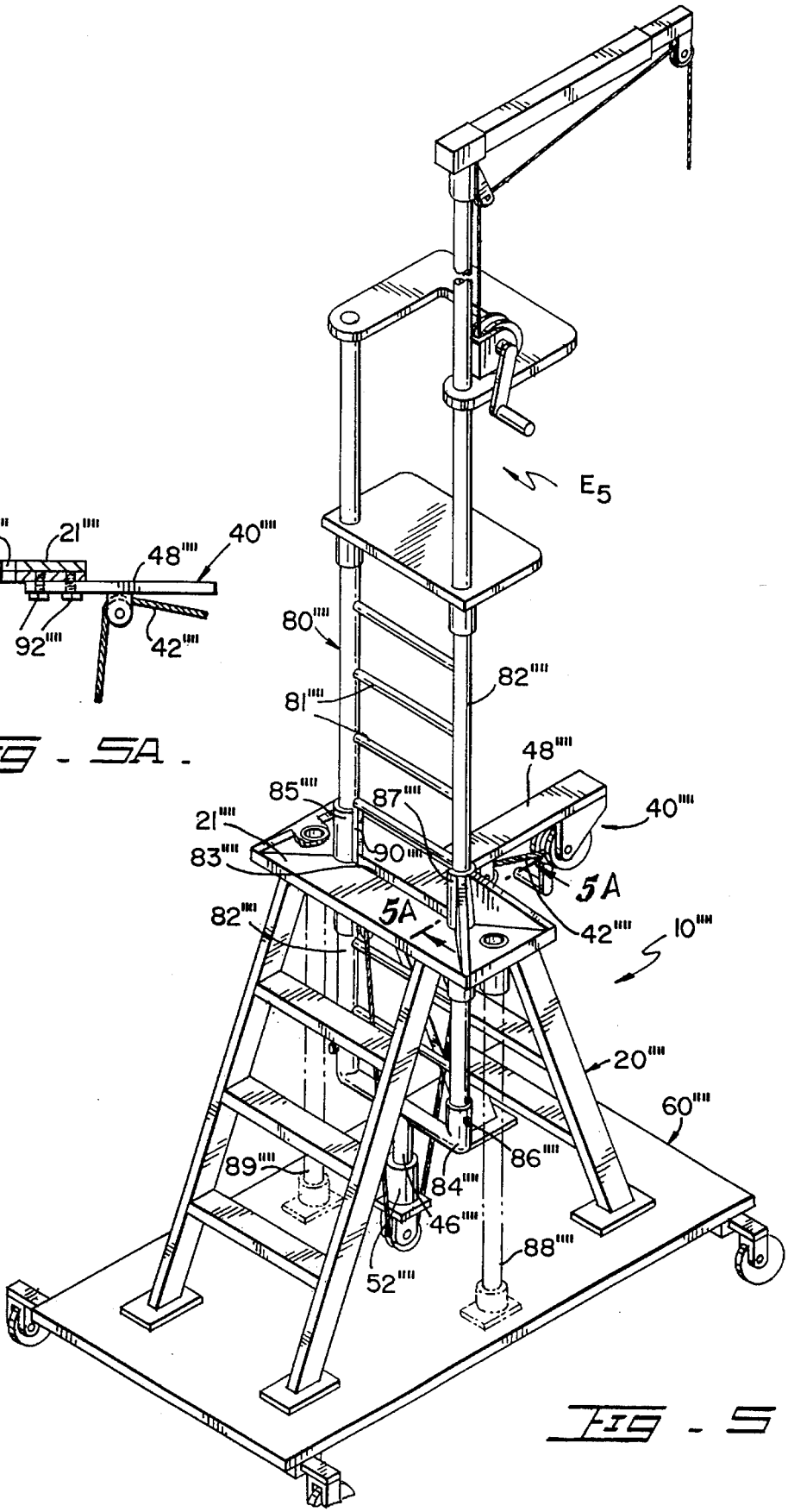
FIG. 5 shows a isometric view from the top of another alternate embodiment holding equipment $E_5$.

In FIG. 5 alternate embodiment 10"" is shown. Stepladder structure 20"" includes lifting mechanism 40"" removably mounted to the underside of reinforcement plate 30'" which is rigidly mounted to head step 21"". Lifting mechanism 40"", in this alternate embodiment, lifts and lowers lifting ladder assembly 80"" removably mounted to receiving tubular member 52"". Arm member 48"" of lifting mechanism 40"" is removably mounted to reinforcement plate 30"" by screws 92"", as best seen in FIG. 5A.

Lifting ladder assembly 80"" includes ladder member 82"" removably mounted, at its lowermost portion, to receiving member 84"" and secured by set screw 86"". Ladder member 82"", in this alternate embodiment, is lifted and lowered through slot 83"" and sleeves 85"" and 87"" located in head step 21"". Slot 83"" permits rung members 81"" to go through. Similarly, sleeves 85"" and 87"" have slits 90"" that permit rung members 81"" to go through. Stepladder 20"" also includes supporting shafts 88"" and 89"" mounted to the underside of the head step 21"". Equipment $E_5$ is removably mounted to the upper end of ladder member 82"". In this manner, a user can reach and operate at a high position.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed, is:

1. A stepladder for positioning equipment and material and said stepladder having two pairs of legs, each pair having legs that are kept in a parallel spaced apart relation with respect to each other and a plurality of connecting step members mounted between the legs of each pair, and said legs resting on a supporting surface, comprising:

A) a head step assembly having an underside and a first opening; and

B) lifting means mounted to said head step assembly including first pulley means and cable means trained thereon, said cable means having two ends, one of said ends being rigidly attached to a fixed point connected to said head step assembly, and further including spool means for collecting said cable means from the other end, and further including first shaft means having first and second ends, said shaft being passed through said first opening and said first end being mounted to said first pulley means so that said equipment and material can be removably mounted to said second end of said shaft to be lifted and lowered.

2. The stepladder set forth in claim 1 wherein said head step assembly includes a second opening and further comprising:

C) second shaft means having third and fourth ends, said third end being removably mounted to said underside and said fourth end resting on said supporting surface thereby enhancing the stability of the stepladder.

3. The stepladder set forth in claim 2 wherein said lifting means is removably mounted to the underside of said head assembly.

4. The stepladder set forth in claim 3 further including:

D) tubular means, having fifth and sixth ends, and said tubular means coaxially housing a portion of said second shaft means adjacent to said third end at said fifth end and including a stopping surface internally positioned within said tubular means at a predetermined distance away from said fifth end; and E) spring means coaxially housing a portion of said second shaft means and said spring means being sandwiched between said head step assembly and said tubular means so that the weight of said equipment and material is transmitted through said spring means to said head step assembly up to a predetermined amount and the balance of the weight of said equipment and material being transmitted through said second shaft means to said supporting surface.

5. The stepladder set forth in claim 4 further comprising:

F) platform means supporting said stepladder and said platform means includes wheel means.

6. The stepladder set forth in claim 5 wherein said wheel means are telescopically mounted to said platform means.

7. The stepladder set forth in claim 3 further comprising:

G) platform means supporting said stepladder and said platform means includes wheel means.

8. The stepladder set forth in claim 7 wherein said wheel means are telescopically mounted to said platform means.

9. A stepladder for positioning equipment and material and said stepladder having two pairs of legs, each pair having legs that are kept in a parallel spaced apart relation with respect to each other and a plurality of connecting step members mounted between the legs of each pair, and said legs resting on a supporting surface, comprising:

A) a head step assembly having an underside and further including first and second openings, and a slot connecting them;

B) lifting means mounted to said head step assembly including first pulley means and cable means trained thereon, said cable means having two ends, one of said ends being rigidly attached to a fixed point connected to said head step assembly, and further including spool means for collecting said cable means from the other end, and further including first shaft means having first and second ends, and said first end being mounted to said pulley means; and C) ladder means including two elongated members kept in a parallel and spaced apart relationship with respect to each other by a plurality of step members and said elongated members and step members being disposed to pass through said first and second openings and said slot, and said ladder means having an upper end and a lower end and said lower end being mounted to said second end.

10. The stepladder set forth in claim 9 further comprising:

D) platform means supporting said stepladder and said platform means includes wheel means.

11. The stepladder set forth in claim 10 wherein said wheel means are telescopically mounted to said platform means.

* * * * *